US006315017B1

(12) United States Patent
Stottmann

(10) Patent No.: US 6,315,017 B1
(45) Date of Patent: Nov. 13, 2001

(54) JOINT JIG FOR USE WITH EITHER A TABLE-MOUNTED OR A HAND-HELD ROUTER

(76) Inventor: Richard L. Stottmann, 5204 Avish La., Harrods Creek, KY (US) 40027

( * ) Notice: Subject to any disclaimer, the term of this patent is extended or adjusted under 35 U.S.C. 154(b) by 0 days.

(21) Appl. No.: 09/592,870

(22) Filed: Jun. 13, 2000

Related U.S. Application Data

(60) Provisional application No. 60/140,232, filed on Jun. 23, 1999.

(51) Int. Cl.[7] ..... B27M 3/00; B27C 5/00

(52) U.S. Cl. ..... 144/372; 144/135.2; 144/137; 144/144.51; 144/145.1; 144/145.2

(58) Field of Search ..... 144/135.2, 137, 144/144.1, 144.51, 145.1, 145.2, 372; 409/125, 130; 33/197, 562, 564, 565

(56) References Cited

U.S. PATENT DOCUMENTS

| | | | |
|---|---|---|---|
| 4,014,090 | 3/1977 | Rusk et al. . | |
| 4,074,736 | 2/1978 | Wolff . | |
| 4,168,730 | 9/1979 | Keller . | |
| 4,405,004 | 9/1983 | Dicke . | |
| 4,428,408 | 1/1984 | Grisley . | |
| 4,630,657 | 12/1986 | Obradovich . | |
| 4,809,755 | 3/1989 | Pontikas . | |
| 4,837,939 | 6/1989 | Pullen . | |
| 5,139,062 | 8/1992 | Keller . | |
| 5,143,132 | 9/1992 | Keller . | |
| 5,161,592 | 11/1992 | Rasmussen . | |
| 5,199,477 | 4/1993 | Keller . | |
| 5,285,580 | 2/1994 | Christensen . | |
| 5,285,832 | 2/1994 | Gibson . | |
| 5,345,986 | 9/1994 | Kieffer . | |
| 5,692,861 | 12/1997 | Stottmann . | |
| 5,711,356 * | 1/1998 | Grisley | 144/144.51 |
| 5,832,977 | 11/1998 | Hampton . | |
| 5,931,208 | 8/1999 | Gifkins . | |
| 6,012,497 | 1/2000 | Stottmann . | |
| 6,116,303 * | 9/2000 | Hampton | 144/144.51 |

OTHER PUBLICATIONS

Hampton House, Katie Jig The Manual, instruction manual, 1997–2000, pp. 1–D–2, Hampton House, Inc.

* cited by examiner

*Primary Examiner*—W. Donald Bray
(74) *Attorney, Agent, or Firm*—Stites & Harbison, PLLC; David W. Nagle, Jr.; Vance A. Smith

(57) ABSTRACT

A jig facilitates the construction of joints in a working piece, and, more particularly, secures the working piece to be cut and allows it to be passed over a fixed router without sacrificing any of the ease of use or quality associated with prior art jigs and templates. The jig also can be secured to a work surface and used with a hand-held router.

21 Claims, 4 Drawing Sheets

JOINT JIG FOR USE WITH EITHER A TABLE-MOUNTED OR A HAND-HELD ROUTER

This application claims priority from U.S. provisional application No. 60/140,232 filed Jun. 23, 1999 and relates to a jig that can be used in conjunction with either a table-mounted or a hand-held router to fabricate various joints, including dovetail joints, usually from wood. The disclosure contained in U.S. provisional application No. 60/140,232 is incorporated herein by reference.

BACKGROUND OF THE INVENTION

In constructing furniture or similar items, woodworkers and craftsman expend substantial effort in fabricating joints (e.g., dovetail and box joints) that are not only precise and sturdy, but also are aesthetically pleasing. For example, the use of dovetail joints to fit parts of furniture together is an admirable and old woodworker art which is generally pleasing to the eye, particularly when the joints are created by hand with a nonuniform, classic appearance. Dovetails made with perfectly fitting joints are considered to be the product of highly skilled craftsmen. Those steeped in knowledge of the art carefully review the quality of the joints and grade the craftsman's woodworking abilities.

A dovetail joint has two different parts, or components, called tails and pins, which fit together in a complimentary fashion to form the attractive looking, strong joint. The most popular dovetail joints are the "half-blind" and the "through" dovetail joints. The half-blind joint can only be seen on one side of the two joined surfaces and is primarily used for flushed and lipped drawers. The through joint can be seen on both surfaces. Whether half-blind or through dovetail joints are being crafted, it is almost axiomatic that the more tails and pins required for a particular woodworking project, the more time-consuming the fabrication becomes. For those who make a living constructing furniture that typically incorporates dovetail joints, a compromise has to be struck between the number of pins seen in the joint and the expense of forming the joint. Also, when too few pins are used in joining a pair of wood members, the resulting joint may be structurally too weak. To reduce the amount of time required to produce dovetail joints, many craftsmen resort to using various types of commercially available "jigs." A "jig," for purposes of this description, may be defined as a device used to mechanically maintain the correct positional relationship between a working piece and the tool. A multi-functional jig producing half-blind or through joints of variable spacing is available from Leigh Industries in Port Coquitlam, British Columbia, Canada. Similarly, Porter-Cable produces a jig, known as the "Omnijig," which is capable of producing various types of dovetail joints, including half-blind and through joints. The jigs, while providing admirable dovetail joints, are complicated to set up and use, and provide only joints of limited length.

Perhaps the easiest-to-use jig for the making of through dovetail joints is the Keller dovetail "template" system, available from Keller & Co., of Petaluma, Calif., which involves, in part, the use of a template. In the woodworking art, the terms "jig" and "template" are used interchangeably. However, to promote clarity in this description, a "template" is distinguished from the aforementioned definition of a "jig" by being defined as a gauge, pattern or mold, typically formed in a thin plate or board, used as a guide for a tool, such as a router, to replicate the pattern of the template in a piece of material secured or fixed to the template. Similarly, a "pattern plate," again for purposes of this description, is defined as a plate having a pattern serving as a guide for a router and the like to fabricate a configuration in a working piece. The Keller system uses machined pattern plates as a guide for a router bit to directly fabricate the mating parts of a dovetail joint, namely, the pins and tails. The Keller system, described in detail in several patents, including U.S. Pat. Nos. 4,168,730; 5,139,062; and 5,199,477, is easy to use and can provide variable length dovetail joints with variable spacing. The Keller system, however, is cumbersome when used to make dovetail joints with variable spacing and often requires the purchase of a different jig. Moreover, the individual cutters and pattern plates comprising the system are expensive and must be replaced when accidentally damaged by a router bit during use or bent by accidentally dropping the plates. The home craftsman has limited ability to repurchase such pattern plates.

U.S. Pat. No. 5,692,861, issued to Stottmann, overcomes many of the problems encountered in the prior art. The Stottmann device is a single planar member having a pair of sides in which the member defines first and second pluralities of elongated openings. The first plurality of elongated openings is positioned adjacent one of the sides of the member, each of said elongated openings extending between oppositely disposed first and second circular ends. These openings further have opposing parallel sides spaced a predetermined distance apart. The first circular ends have diameters substantially equal to this distance, while the second circular ends have diameters larger than this distance.

The second plurality of openings in the Stottmann template is positioned adjacent the other side of the planar member. A first portion of the second openings has spaced opposing sides that are parallel, while a second portion of the second openings has opposing sides that converge toward one another and away from the first portion. The convergence of the sides of the second openings defines an angle substantially equal to the slope angle of the preselected dovetail cutter bit.

In using this template, the template is preferably first positioned over a rectangular form, comprised of inexpensive, but cuttable material. In one preferred method of construction, starter holes are also drilled into the underlying form. A starter bit is passed through the enlarged diameter holes of selected openings of the plurality of first openings, and then through selected openings of the second portion of the plurality of second openings. A pattern cutter bit, of a diameter less than the diameter of the starter holes, with a rotatable guide bearing is inserted through the openings so that the cutter bit extends into the starter holes, and the rotatable bearing is rotatably engaged with the side of the openings. A plurality of pin openings and a plurality of dovetail openings are then cut in the form. The form, now a unitary pattern plate, is removed from the template and ready to use.

The described Stottmann device thus provides for the creation of a fixed-length pattern plate which is then used for fabricating the dovetails and pins. This is preferred because the template itself is subject to damage if it is used to directly cut the dovetails and pins, and replacement of the template can be costly.

U.S. Pat. No. 6,012,497, also issued to Stottmann, further improves upon the device of the '861 patent and describes an inexpensive device that allows for the creation of dovetail joints of unlimited length. Furthermore, this device can be used both as a pattern plate, eliminating the intermediate step of using a template to cut a pattern plate, or as a template.

Specifically, the device described in the '497 patent is a panel that can used either as a pattern plate or a template. This panel is preferably a planar member having a generally rectangular shape, including a pair of sides, a left edge, and a right edge. The panel defines first and second pluralities of elongated openings. The first plurality of elongated openings is positioned adjacent one of the sides of the panel, each of the openings extending between oppositely disposed first and second circular ends. Each opening further has opposing parallel sides spaced a predetermined distance apart. The first circular end has a diameter substantially equal to this distance, while the second circular end has a diameter greater than this distance. Additionally, the panel defines "half-openings" along its left and right edges. Thus, when two panels are placed side-by-side, the adjacent half-openings form the above described first elongated opening.

The second plurality of openings is positioned adjacent the other side of the panel. A first portion of the second openings has spaced opposing sides that are parallel, while a second portion has opposing sides that converge toward one another. The convergence of the sides of the second openings defines an angle substantially equal to the angle of the preselected dovetail cutter bit. Again, the panel defines "half-openings" along its left and right edges. Thus, when two panels are placed side-by-side, the adjacent half-openings form the above-described second elongated opening.

With the half-openings along either edge of the panel, a series of panels may be placed side-by-side to fabricate dovetails of an unlimited length. Because of the modularity of these panels, if an individual panel is damaged, it may be replaced without affecting the adjacent panels.

Keller, Stottmann, and similar prior art references thus each disclose methods and devices for fabricating dovetail joints wherein the router is passed over and through a template or jig to fabricate the desired joints. Such manipulation of the router, however, may be difficult due to the weight of the router. Furthermore, this manipulation of the router often causes vibrations that can hinder accurate and precise cutting of the pins and tails for dovetail joints.

It is therefore a paramount object of the present invention to provide a jig that secures the working piece and allows the working piece to be passed over a fixed router without sacrificing any of the ease of use or quality associated with the jigs and templates taught by Stottmann and others in the prior art.

It is another important object of the present invention to provide a jig that permits both the jig and the working piece to be passed over a table-mounted router, thereby permitting smaller or thinner pieces of wood to be cut.

It is yet another important object of the present invention to provide for a dovetail jig and router system that minimizes vibrations during the cutting process.

It is still yet another important object of the present invention to provide a jig that can be used with a hand-held router if desired.

These and other objects and advantages of the present invention will become apparent upon a reading of the following description.

SUMMARY OF THE INVENTION

The present invention is a device that facilitates the construction of joints in a working piece, and, more particularly, to a jig that secures the working piece to be cut and allows it to be passed over a fixed router without sacrificing any of the ease of use or quality associated with prior art jigs and templates. If desired, however, the jig can also be secured to a work surface and used with a hand-held router. The preferred jig is essentially comprised of a base board, a brace board, a clamp board, a backer board, and a template board. The brace board is secured to the upper lateral surface of the base board along one of the edges of the base board. The backer board is then secured essentially perpendicularly to the base board and brace board along that same edge. These boards are either secured to one another using standard fasteners or can be formed as a unitary body.

The clamp board is not rigidly secured to the other boards but is moveable relative to the backer board for securing said working piece between said clamp board and said backer board. Once the working piece is secured, the jig and working piece can be passed over a table-mounted router for cutting a joint pattern into the working piece. Or, a hand-held router can be used to cut the joint pattern in the secured working piece.

DESCRIPTION OF THE PREFERRED EMBODIMENTS

The present invention relates to a device that facilitates the construction of joints in a working piece, and, more particularly, to a jig that secures the working piece to be cut and allows it to be passed over a fixed router without sacrificing any of the ease of use or quality associated with prior art jigs and templates. If desired, however, the jig can also be secured to a work surface and used with a hand-held router. Finally, the use of the preferred jig is not restricted to the construction of dovetail joints, but may also be used in the fabrication of other common joints, such as box joints.

Figure 1:
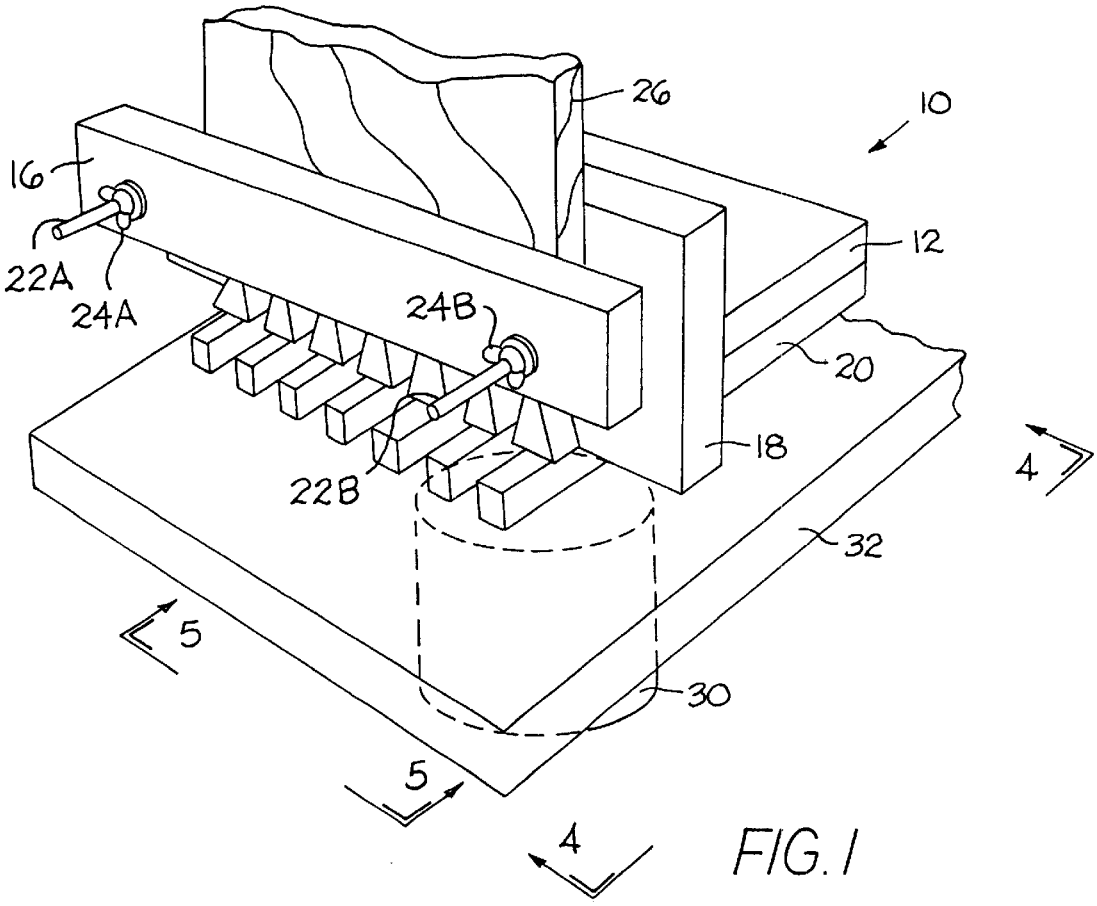
FIG. 1 is a perspective view of a preferred jig made in accordance with the present invention being used with a table-mounted router to cut a tail board for a dovetail joint.
Figure 4:
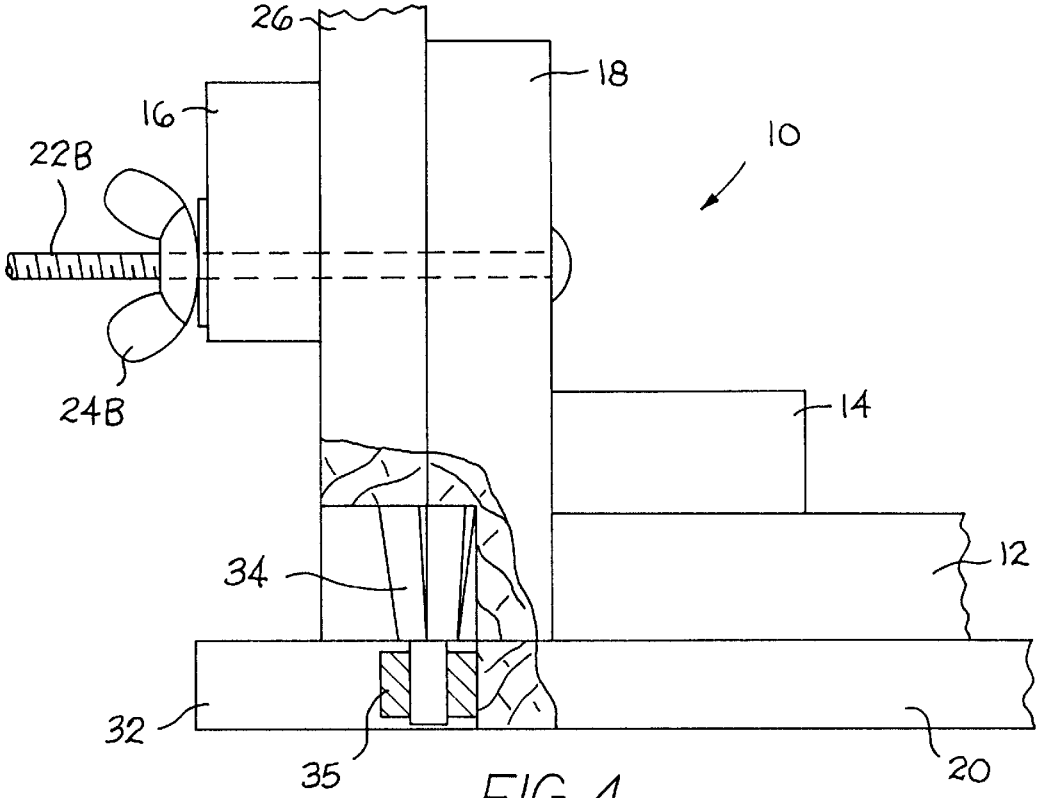
FIG. 4 is a side view of the preferred jig and table-mounted router of FIG. 1 taken along line 4—4 of FIG. 1.
Figure 6:
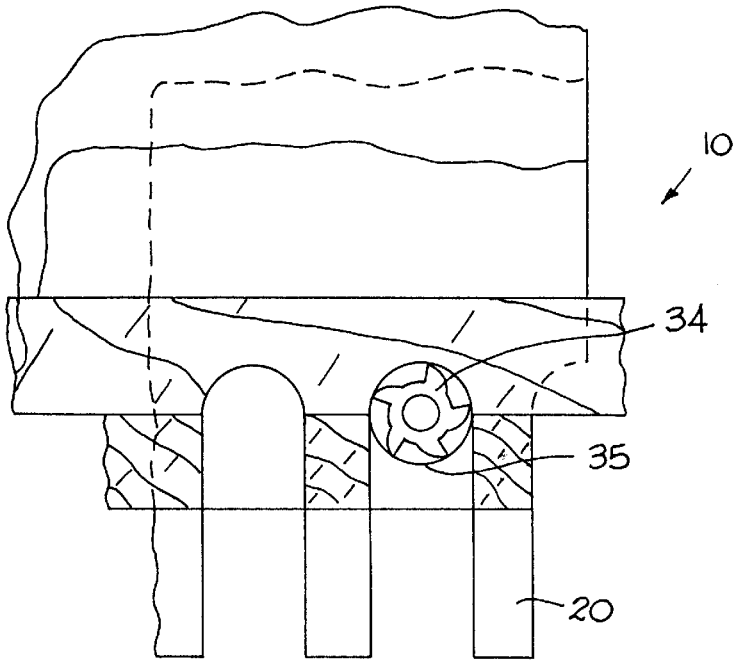
FIG. 6 is partial sectional view of the preferred jig and table-mounted router of FIG. 1 taken along line 6—6 of FIG. 5.
Figure 5:
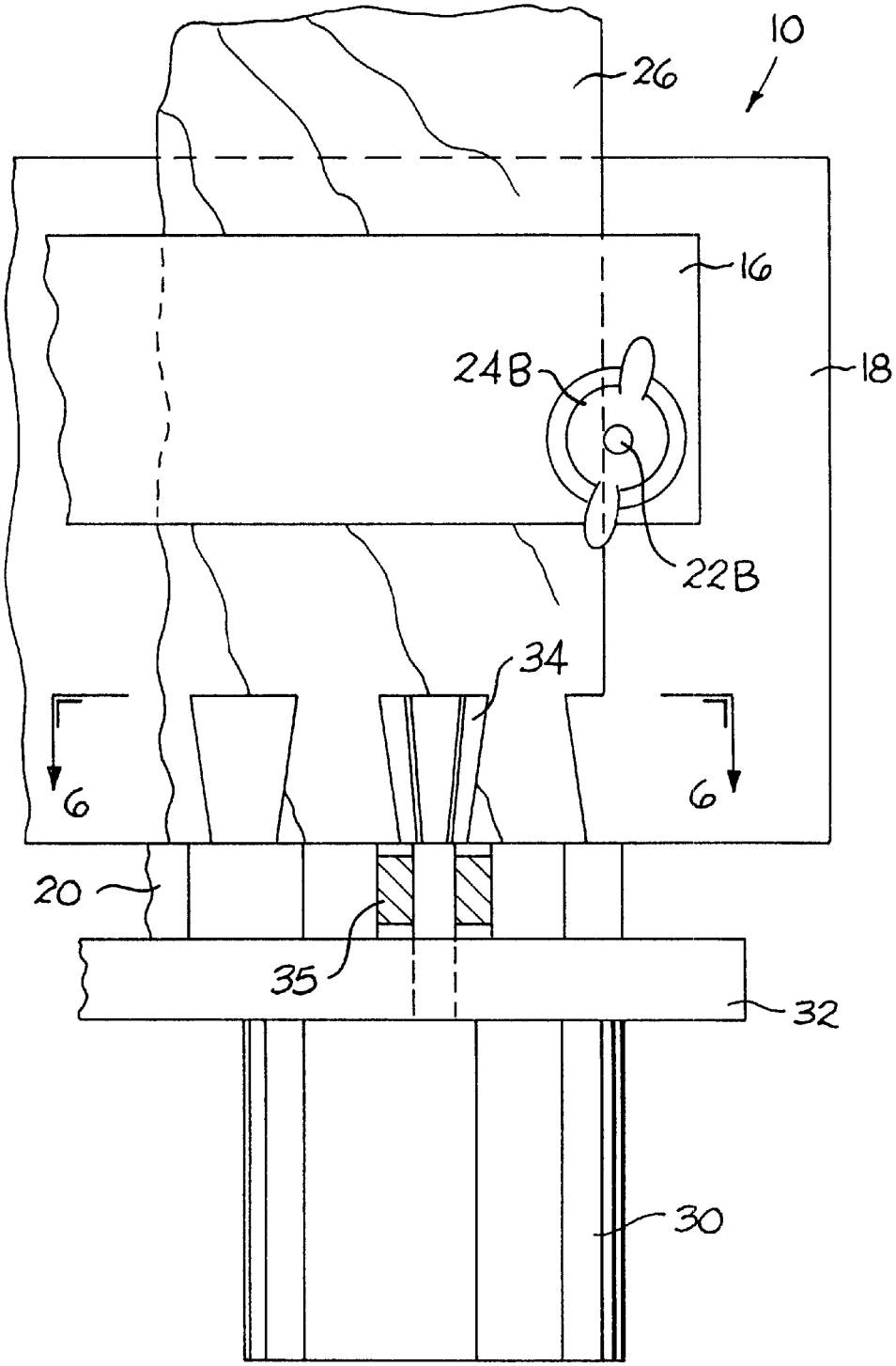
FIG. 5 is a partial front view of the preferred jig and table-mounted router of FIG. 1 taken along line 5—5 of FIG. 1.

FIG. 1 shows the construction and use of the preferred jig 10 of the present invention to cut a tail board for a dovetail joint. The jig 10 is essentially comprised of a base board 12, a brace board 14 (shown in FIG. 4), a clamp board 16, a backer board 18, and a template board 20. The brace board 14 is secured to the upper lateral surface of the base board 12 along one of the edges of the base board 12. The backer board 18 is then secured essentially perpendicularly to the base board 12 and brace board 14 along that same edge. The securing of these boards to one another to form the jig 10 is preferably accomplished through a combination of wood screws (or similar fasteners) and glue (or a similar adhesive).

Also, rather than constructing the preferred jig 10 from multiple wooden boards, it is recognized that the base board 12, brace board 14, and backer board 18 (and also the template board 20, which is described further below) could be formed as a unitary body, for example, through injection molding of a plastic, or through casting of a metal, such an aluminum.

The clamp board 16 is not rigidly secured to the other boards but is preferably mounted on a plurality of carriage bolts 22A, 22B (two in this embodiment) which extend from the backer board 18 and define axes that are substantially parallel to the base board 12. The clamp board 16 defines corresponding through holes that allow the clamp board to be freely moved along the length of these carriage bolts 22A, 22B; however, associated washer and wing nut assemblies 24A, 24B allow the position of the clamp board 16 to be fixed relative to the backer board 18. This is but one preferred method to secure the board 26 in position against the backer board 18. Standard woodworking clamps or other securing means could be used in place of the clamp board 16 to secure the board 26 to the backer board 18 without departing from the spirit and scope of the present invention. Furthermore, if a clamp board 16 is used, various other fasteners, including threaded knobs, could be used to secure the clamp board 16 without departing from the spirit and scope of the present invention.

The final component of the preferred jig 10 is the template board 20. In this example, the template board 20 is preferably formed by using one of the dovetail templates taught and described in U.S. Pat. Nos. 5,692,861 and 6,012,497 issued to Stottmann. U.S. Pat. Nos. 5,692,861 and 6,012,497 are thus incorporated herein by reference. Of course, other templates, such as a template for a box joint, could be used without departing from the spirit and scope of the present invention.

Returning to the preferred embodiment depicted in the accompanying Figures, a tail template board for a dovetail joint is shown in FIG. 1. The template board 20 is secured to the lower lateral surface of the base board 12 with the "fingers" of the template 20 board, which may be referred to as a "router pattern," beyond the backer board 18. Also, as mentioned above, the entire jig 10 could be formed as a unitary body, for example, through injection molding of a plastic or casting of a metal.

FIG. 1 also demonstrates how the preferred jig of the present invention is used with a table-mounted router to cut the tail board for a dovetail joint. As shown, the board 26 to be cut, referred to as the working piece, is positioned between the backer board 18 and clamp board 16 with the end of the working piece 26 abutting the template board 20. The washer and wing nut assemblies 24A, 24B are tightened so that the clamp board 16 presses against the working piece 26, rigidly securing it against the backer board 18 so that it will not move during the cutting operation.

The jig 10 and working piece 26 are now ready for the cutting operation. As best shown with reference to FIGS. 3–6, the jig 10 and working piece 26 are passed over a table-mounted router 30. A table 32 defines a lateral support surface; the blade 34 of the router 30 with bearing 35 (or bushing) extends through this support surface and is maintained in a substantially vertical position. The jig 10 is manipulated over this table-mounted router 30, the blade 34 of the router 30 being guided by the template board 20 and bearing 35 so that the appropriate cuts are made in the working piece 26.

Figure 2:
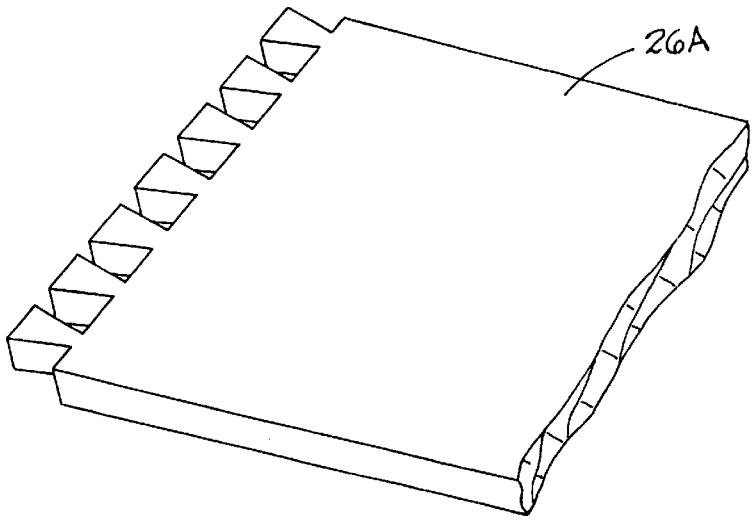
FIG. 2 is a perspective view of the completed tail board of FIG. 1.
Figure 3:
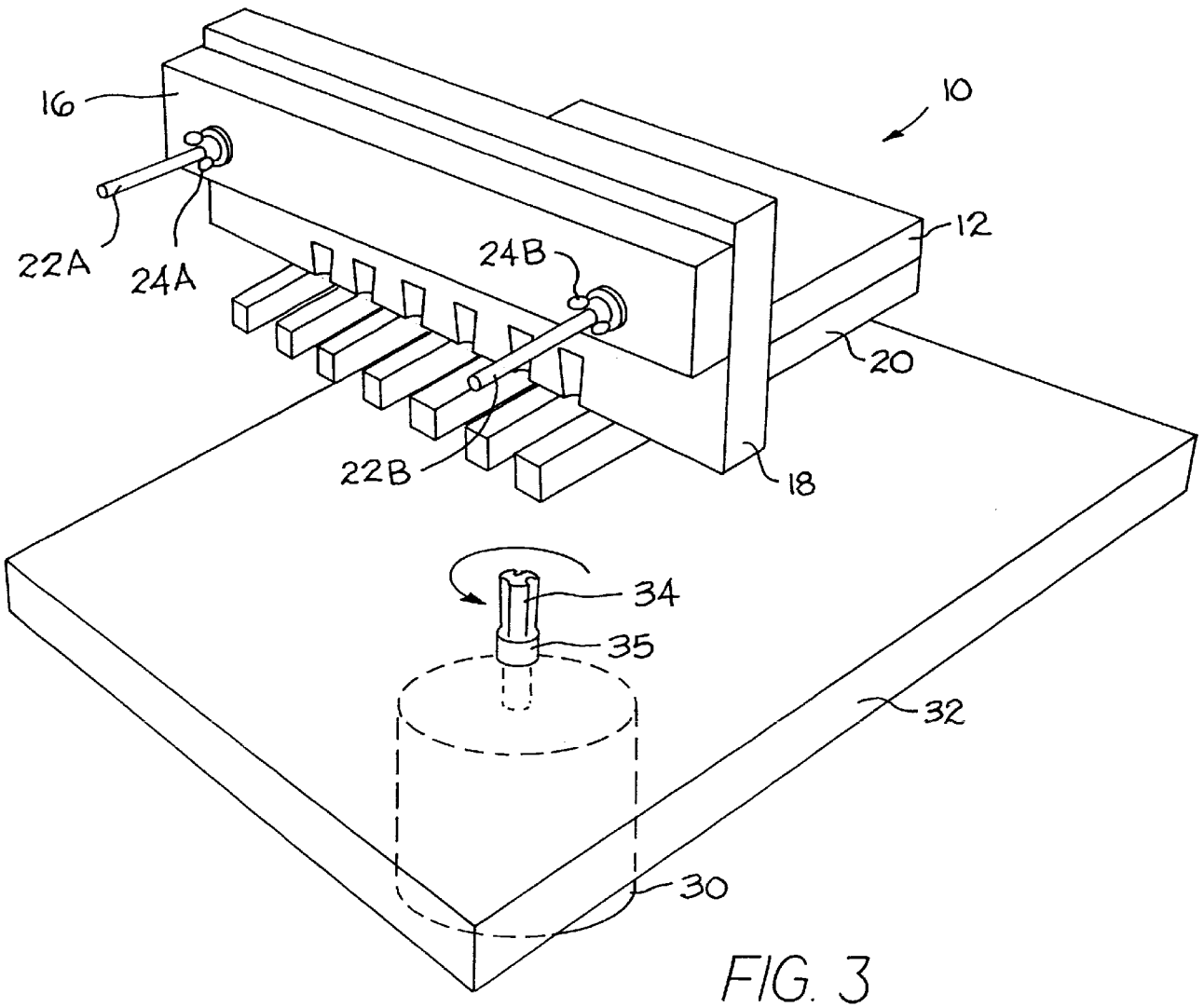
FIG. 3 is a perspective view of the preferred jig and table-mounted router of FIG. 1.

FIG. 2 shows a completed tail board 26A made using the jig 10 of the present invention.

Since the backer board 18 may be damaged during the cutting operation, it may be desirable to employ a two-piece backer board 18, or a front backer board (for contacting the working piece 26) and a rear backer board (secured to the base board 12 and brace board 14). Such a construction would allow the front backer board, which may be damaged by the cutting blade 34, to be periodically replaced without requiring a dismantling of the entire jig 10. Furthermore, varying the thickness of the backer boards also allows for the use of different diameter router bits.

It is also important to note that, although a router bit bearing 35 is shown and described, a guide bushing attached to the router or router table could be used (instead of the bit bearing 35) in the cutting operation described above.

Also, to promote safety, a protective shield may be incorporated into the clamp board 16 shown and described above to keep an operator's fingers away from the router blade 34.

By fixing the router 30 and moving the jig 10, the operator can make more accurate and precise cuts as the operator does not have to handle and control the weight of the router. Moreover, thinner wood can be cut as the wood does not have to support the weight of the router and jig. Similarly, the jig itself can be made of lighter materials because it does not have to support the weight of the router.

Although not shown in the drawings, at times, it may be desirable to secure the jig to a work surface and use a hand-held router to cut the joint pattern, for example, when large or thick pieces of wood need to be cut. This is also easily accomplished using the jig of the present invention.

It will be obvious to those skilled in the art that modifications may be made to the preferred embodiments described herein without departing from the spirit and scope of the present invention.

What is claimed is:

1. A jig for securing a working piece for fabrication of a joint pattern in said working piece, comprising:

a base board having an upper lateral surface and a lower lateral surface;

a backer board secured to said base board along an edge thereof, said backer board being oriented substantially perpendicular to said base board;

a clamping means for securing said working piece to said backer board;

a template board defining a router pattern along a first side thereof, said template board being secured to said base board adjacent the lower lateral surface of said base board, the first side of said template board extending beyond said backer board and abutting said working piece, thereby allowing a router to be moved through said router pattern to cut said joint pattern into the working piece.

2. A jig as recited in claim 1, wherein said clamping means is a clamp board oriented substantially parallel to said backer board and moveable relative to said backer board for securing said working piece between said clamp board and said backer board.

3. A jig as recited in claim 1, and further comprising a brace board secured to the upper lateral surface of said base board adjacent said backer board.

4. A jig as recited in claim 2, and further comprising at least two bolts secured to and extending from said backer board, said clamp board defining corresponding holes for receiving said bolts, said clamp board moving relative to said backer board along said bolts.

5. A jig as recited in claim 4, and further comprising at least two wing nuts, said wing nuts being adapted to move along said bolts, thus fixing the position of said clamp board relative to said backer board.

6. A jig as recited in claim 1, wherein the router pattern of said template board comprises:

a plurality of elongated openings extending between oppositely disposed first and second circular ends, said elongated openings having opposing parallel sides spaced a distance apart substantially equal to a diameter of a bearing of a preselected router bit, said first circular ends having diameters substantially equal to said distance and said second circular ends having diameters larger than said distance.

7. A jig as recited in claim 1, wherein the router pattern of said template board comprises:

a plurality of openings, one portion of said openings having spaced opposing sides that are parallel and another portion having opposing sides that converge toward one another in a direction away from said first portion, said parallel spaced sides being separated by a distance greater than a diameter of a bearing of a preselected router bit.

8. A method of fabricating a joint pattern in a working piece, the steps of said method comprising:

securing said working piece in a jig between a backing member and a clamping member, said clamping member being moveable relative to said backing member, and said backing member being secured to a base member and oriented substantially perpendicular to said base member;

providing a template defining a router pattern along a first side thereof, said template being secured to said base member adjacent a lower lateral surface of said base member with the first side of said template extending beyond said backing member and abutting said working piece;

passing said jig and said working piece over a table-mounted router, the blade of said router passing through and being guided by the router pattern of said template to cut said joint pattern into the working piece.

9. A method as recited in claim 8, wherein said clamping member is moveable along at least two bolts secured to and extending from said backing member, said clamping member defining corresponding holes for receiving said bolts.

10. A method as recited in claim 9, wherein the position of said clamping member relative to said backing member can be fixed by at least two wing nuts being adapted to move along said bolts.

11. A method as recited in claim 8, wherein the router pattern of said template comprises:

a plurality of elongated openings extending between oppositely disposed first and second circular ends, said elongated openings having opposing parallel sides spaced a distance apart substantially equal to a diameter of a bearing of a preselected router bit, said first circular ends having diameters substantially equal to said distance and said second circular ends having diameters larger than said distance.

12. A method as recited in claim 8, wherein the router pattern of said template comprises:

a plurality of openings, one portion of said openings having spaced opposing sides that are parallel and another portion having opposing sides that converge toward one another in a direction away from said first portion, said parallel spaced sides being separated by a distance greater than a diameter of a bearing of a preselected router bit.

13. A method of fabricating a joint pattern in a working piece, the steps of said method comprising:

securing said working piece in a jig between a backing member and a clamping member, said clamping member being moveable relative to said backing member, and said backing member being secured to a base member and oriented substantially perpendicular to said base member;

providing a template defining a router pattern along a first side thereof, said template being secured to said base member adjacent a lower lateral surface of said base member with the first side of said template extending beyond said backing member and abutting said working piece;

manipulating the blade of a hand-held router through the router pattern of said template to cut said joint pattern into the working piece.

14. A method as recited in claim 13, wherein said clamping member is moveable along at least two bolts secured to and extending from said backing member, said clamping member defining corresponding holes for receiving said bolts.

15. A method as recited in claim 14, wherein the position of said clamping member relative to said backing member can be fixed by at least two wing nuts being adapted to move along said bolts.

16. A method as recited in claim 13, wherein the router pattern of said template comprises:

a plurality of elongated openings extending between oppositely disposed first and second circular ends, said elongated openings having opposing parallel sides spaced a distance apart substantially equal to a diameter of a bearing of a preselected router bit, said first circular ends having diameters substantially equal to said distance and said second circular ends having diameters larger than said distance.

17. A method as recited in claim 13, wherein the router pattern of said template comprises:

a plurality of openings, one portion of said openings having spaced opposing sides that are parallel and another portion having opposing sides that converge toward one another in a direction away from said first portion, said parallel spaced sides being separated by a distance greater than a diameter of a bearing of a preselected router bit.

18. A jig for securing a working piece for fabrication of a joint pattern in said working piece, comprising:

a unitary body including: a base portion having an upper lateral surface and a lower lateral surface; a backer portion oriented substantially perpendicular to said base portion along an edge thereof; and a template portion defining a router pattern along a first side thereof, the first side of said template portion extending from the lower lateral surface of said base portion beyond said backer portion and abutting said working piece; and a clamping means for securing said working piece to said backer portion;

wherein a router can be moved through said router pattern to cut said joint pattern into the working piece.

19. A jig as recited in claim 18, wherein said clamping means is a clamp board oriented substantially parallel to the backer portion of said unitary body and moveable relative to said backer portion for securing said working piece between said clamp board and said backer portion.

20. A jig as recited in claim 18, wherein said unitary body is composed of a plastic.

21. A jig as recited in claim 18, wherein said unitary body is composed of a metal material.

* * * * *